US007437896B2

(12) United States Patent
Hirao et al.

(10) Patent No.: US 7,437,896 B2
(45) Date of Patent: Oct. 21, 2008

(54) SOCK AND PRODUCTION METHOD OF THE SAME

(75) Inventors: Osamu Hirao, Matsubara (JP); Noriyoshi Yoshimura, Matsubara (JP)

(73) Assignee: Cooma Co., Ltd., Osaka (JP)

( * ) Notice: Subject to any disclaimer, the term of this patent is extended or adjusted under 35 U.S.C. 154(b) by 0 days.

(21) Appl. No.: 10/592,980

(22) PCT Filed: Mar. 16, 2005

(86) PCT No.: PCT/JP2005/004631

§ 371 (c)(1),
(2), (4) Date: Jun. 13, 2007

(87) PCT Pub. No.: WO2005/087027

PCT Pub. Date: Sep. 22, 2005

(65) Prior Publication Data

US 2008/0034802 A1 Feb. 14, 2008

(30) Foreign Application Priority Data

Mar. 16, 2004 (JP) ..... 2004-075249

(51) Int. Cl.
*D04B 9/56* (2006.01)

(52) U.S. Cl. ..... 66/186; 2/239

(58) Field of Classification Search ..... 66/185–187; 2/239, 241

See application file for complete search history.

(56) References Cited

U.S. PATENT DOCUMENTS

| | | | | |
|---|---|---|---|---|
| 3,226,952 | A * | 1/1966 | Cassady | 66/9 B |
| 5,211,035 | A * | 5/1993 | Hanson, II | 66/51 |
| 6,381,755 | B2 * | 5/2002 | Cortani | 2/239 |
| 6,935,141 | B2 * | 8/2005 | Takeda et al. | 66/187 |
| 7,059,156 | B2 * | 6/2006 | Takeda et al. | 66/51 |

FOREIGN PATENT DOCUMENTS

| | | |
|---|---|---|
| JP | 9296343 | 11/1997 |
| JP | 11217703 | 8/1999 |

* cited by examiner

*Primary Examiner*—Danny Worrell
(74) *Attorney, Agent, or Firm*—The Webb Law Firm

(57) ABSTRACT

There is provided a sock that causes no feeling of tightness or pressure when a toe is housed, has no connecting portion, causes no tightening of knitted fabric itself, and has good appearance. The sock includes a toe housing portion that forms a laterally asymmetrical substantially planar trapezoidal shape slanted to a thumb side that is provided continuously with a cylindrically knitted portion. The cylindrically knitted portion forms a sole portion and an instep portion. The toe housing portion is provided with a forward knitted portion for increasing thickness between a front portion and a back portion invertedly knitted to form a substantially planar trapezoidal shape, along contours thereof.

9 Claims, 10 Drawing Sheets

PRIOR ART

SOCK AND PRODUCTION METHOD OF THE SAME

BACKGROUND OF THE INVENTION

1. Field of the Invention

The present invention relates to a sock knitted and produced by a sock knitting machine, and a production method thereof.

2. Description of Related Art

Generally, a sock 101 as shown in FIG. 8 is knitted by a sock knitting machine using a circular knitting machine provided with a needle shuttle rotatably in forward and reverse directions, the needle shuttle having a plurality of knitting needles arranged on a circumference thereof. In knitting of the sock 101, as shown in FIGS. 9A to 9C, a toe housing portion 120 that houses a toe is knitted continuously with a cylindrically knitted portion 110 that forms a sole portion 111 and an instep portion 112.

In the knitting of the toe housing portion 120, generally, first, as shown in FIG. 9C, a back portion 121 of the toe housing portion 120 is knitted continuously with an end (an AB position) of the sole portion 111 of the cylindrically knitted portion 110. At this time, inversion knitting of alternately repeating forward rotation and reverse rotation of the sock knitting machine is performed, knitting needles that contribute to knitting at opposite inversion positions are reduced, for example, by one stitch (one wale) for each knitting course from a knitting needle region of a maximum knitting width toward a knitting needle region of a target minimum knitting width, and knitting is performed while gradually reducing the knitting width. When the knitting needle region of the minimum knitting width (a CD position) is reached, inversion knitting is performed continuously therewith toward the knitting needle region of the maximum knitting width contrary to the above as shown in FIG. 9A, knitting needles that contribute to knitting at opposite inversion positions are increased, for example, by one stitch (one wale) for each knitting course contrary to the above, and the front portion 122 of the toe housing portion 120 is knitted with gradually increasing the knitting width. At this time, opposite ends of the back portion 121 and the front portion 122 are connectedly knitted and connected. Reference numerals 124 and 124 in FIG. 9B denote the opposite connecting portions (gore lines). An end of the front portion 122 is finally connectedly knitted to an opening end of the instep portion 112 of the cylindrically knitted portion 110 and seamed together. Reference numeral 115 denotes the seam portion.

The conventional sock 101 knitted as described above has the toe housing portion 120 laterally symmetrical, and fits either right or left foot. However, the back portion 121 and the front portion 122 of the toe housing portion 120 are continuously folded back at a tip portion, and directly connectedly knitted at the opposite ends thereof, and a thickness (bulge) of the toe housing portion 120 is not very large. Thus, when a toe is housed in the toe housing portion 120, there is a feeling of tightness or pressure in a tip portion of the toe. Particularly, sock knitted fabric is stretched on the side of a thumb that is large and protrudes among fingers of a foot to cause a feeling of heavy pressure.

As a method for solving such a problem, a production method of a sock disclosed in Japanese Patent No. 2895473 has been proposed.

The proposed production method of a sock is basically a method of knitting by a sock knitting machine as is conventional. In knitting of a toe housing portion, while continuously knitting a back portion and a front portion of the toe housing portion by inversion knitting (between the back portion and the front portion), increase or decrease of knitting needles that contribute to knitting at laterally opposite inversion positions is changed to add a knitted fabric portion for increasing thickness on a thumb side, and a knitting direction for increasing thickness is shifted to the thumb side using a way of knitting of the added knitted fabric portion. Specifically, in the inversion knitting, the knitted fabric portion for increasing thickness is added to be slanted to the thumb side, and the knitted fabric itself is shifted in a stretched manner toward the thumb side. Also, due to the inversion knitting, the added knitted fabric portion is connectedly knitted with stitches changed to both the back portion and the front portion of the toe housing portion on the thumb side, and the connecting portions (gore lines) are branched.

In the proposed sock, the entire toe housing portion is shifted to the thumb side by the added knitted fabric portion, and the thickness and a radial bulge on the thumb side are increased, thereby preventing a feeling of tightness or pressure on the thumb side when the toe is housed. However, the branched connecting portions (gore lines) between the added knitted fabric portion and the back portion and the front portion of the toe housing portion are connected with the stitches changed and are conspicuous, a connection state is not very neat, the sock is poor in appearance, and the shift to the thumb side causes the knitted fabric itself to be tightened, thereby reducing commercial value. Also, for the added knitted portion, functions other than the function of increasing the thickness of the thumb side cannot be expected.

DISCLOSURE OF THE INVENTION

SUMMARY OF THE INVENTION

The present invention is achieved in view of the above, and provides a sock that has an increased thickness (bulge) of the entire toe housing portion and also has various functions, can be worn without a feeling of tightness or pressure, has no branched and conspicuous connecting portion (gore line) on a side of the toe housing portion, causes no tightening of knitted fabric itself, and has good appearance, and further a sock having various other functions in a contour portion of the toe housing portion, and a production method for easily obtaining such a sock.

The present invention that solves the above described problem provides a sock knitted integrally by a sock knitting machine, the sock having a cylindrically knitted portion which forms a sole portion and an instep portion, and a toe housing portion provided continuously with the cylindrically knitted portion, characterized in that the toe housing portion includes an invertedly knitted front portion having a substantially planar trapezoidal shape, an invertedly knitted back portion having a substantially planar trapezoidal shape, and a knitted portion which is provided as a forwardly knitted portion between the invertedly knitted front portion and the invertedly knitted back portion along contours of these front and back portions.

The sock includes the knitted portion provided as a forwardly knitted portion between the front portion and the back portion in a contour portion of the toe housing portion, that is, contour portions of a tip portion and opposite sides, and thus the entire toe housing portion has a larger thickness than conventional socks and has a three-dimensional bulge, and causes no feeling of tightness or pressure in fingertips when a toe is housed.

Further, the sock may have various other functions of providing breathability to the contour portion of the toe housing portion, knitting patterns, or increasing strength, or the like, using a knitting texture of the forwardly knitted portion.

The knitted portion for increasing thickness is forwardly knitted in the entire contour portion of the toe housing portion, thus on the opposite sides of the toe housing portion, two connecting portions (gore lines) of the knitted portion for increasing thickness and the back portion and the front portion of the toe housing portion simply appear in parallel and are inconspicuous, and the sock is simple and neat, causes no tightening of knitted fabric itself, and has good appearance.

In the sock, the toe housing portion preferably has a laterally asymmetrical substantially planar trapezoidal shape slanted to a thumb side. In this case, even on the side of the thumb that is the largest and protrudes among fingers of a foot, the knitted fabric itself is not locally stretched and no feeling of pressure is caused, and the sock can be worn comfortably with good appearance.

In the sock, a small toe portion projecting in a substantially planar trapezoidal shape continuously with the knitted portion may be provided at a part of the forwardly knitted portion of the toe housing portion. In this case, a tip portion of the thumb that is the largest and protrudes among fingers of a foot may be housed in the small toe portion, and the sock can be worn with good appearance without a feeling of tightness.

Particularly, the small toe portion is provided at a part of the knitted portion so as to be slanted to the thumb side, and thus the tip portion of the thumb can be properly housed, and the knitted fabric is not excessively stretched. Further, a forward knitted portion is provided between a front side and a back side of the small toe portion along contours thereof, a thickness of the small toe portion is increased, and the tip portion of the thumb further can be housed without a feeling of tightness, and the sock can be worn extremely comfortably and has good appearance.

The other of the present invention is a method of knitting a sock as described above by a sock knitting machine, having the steps of knitting a cylindrically knitted portion forming a sole portion and an instep portion integrally with each other and knitting a toe housing portion for accommodating a toe continuously with the cylindrically knitted portion, characterized in that at the step of knitting the toe housing portion, both a front portion and a back portion of the toe housing portion are invertedly knitted with changing knitting widths thereof so as to form a substantially planar trapezoidal shape having a progressively reduced knitting width toward a tip of the sock, and a knitted portion is forwardly knitted between the invertedly knitted front portion and the invertedly knitted back portion along respective contours thereof, thus forming a knitted portion for increasing thickness between the front portion and the back portion. This allows the sock having the above described features to be knitted.

In the production method of the sock, in knitting one of the back portion and the front portion of the toe housing portion by inversion knitting, the number of knitting needles relating to knitting is gradually reduced at a predetermined rate at an inversion position of one of forward rotation and reverse rotation of the sock knitting machine and an inversion position of the other. In knitting the other of the back portion and the front portion of the toe housing portion by inversion knitting, the number of knitting needles relating to the knitting is gradually increased at a predetermined rate at the inversion position of one of forward rotation and reverse rotation of the sock knitting machine and the inversion position of the other. Thus, the toe housing portion in a substantially planar trapezoidal shape having a progressively reduced knitting width toward a tip and provided with a forwardly knitted portion between the back portion and the front portion along contours thereof without problems, and the sock having the above described features can be easily obtained.

With different rates of decrease or increase of the number of knitting needles relating to knitting at opposite inversion positions in inversion knitting of the back portion or the front portion of the toe housing portion, knitting is performed to form a substantially planar trapezoidal shape or a substantially planar inverted trapezoidal shape slanted to one inversion position, thereby allowing a sock having a substantially planar trapezoidal shape with the toe housing portion slanted to a thumb side to be produced.

Further, as described above, in the course of knitting the forwardly knitted portion along the contour portion of the toe housing portion with forward operation of the sock knitting machine, in a knitting needle region for knitting the toe housing portion of the sock knitting machine, a front side and a back side of a small toe portion are invertedly knitted respectively while changing knitting widths thereof, thereby making it possible to form a substantially planar trapezoidal shape having a progressively reduced knitting width toward a tip of the sock.

Thus, the sock can be knitted provided with the small toe portion projecting in a substantially planar trapezoidal shape continuously with the knitted portion, at a part of the knitted portion for increasing thickness of the toe housing portion.

As described above, according to the sock of the present invention, the forwardly knitted portion along the contour portion of the toe housing portion can increase the thickness of the entire toe housing portion, and the sock can be comfortably worn without causing a feeling of tightness or pressure in the thumb side and also in the entire fingertips when the toe is housed. Also, the sock has no branched and conspicuous connecting portion (gore line) on the side of the toe housing portion, causes no tightening of the knitted fabric itself, and has extremely good appearance. Further, the sock may have various functions, besides increasing thickness, of providing breathability to the contour portion of the toe housing portion, knitting patterns, or increasing strength, or the like, using a knitting texture of the forwardly knitted portion.

According to a production method of a sock of the present invention, a sock having the above described advantage can be easily and efficiently knitted and produced by a sock knitting machine like a conventional one.

DETAILED DESCRIPTION OF THE PRESENT INVENTION

Next, an embodiment of the present invention will be described with reference to the drawings.

Figure 1:
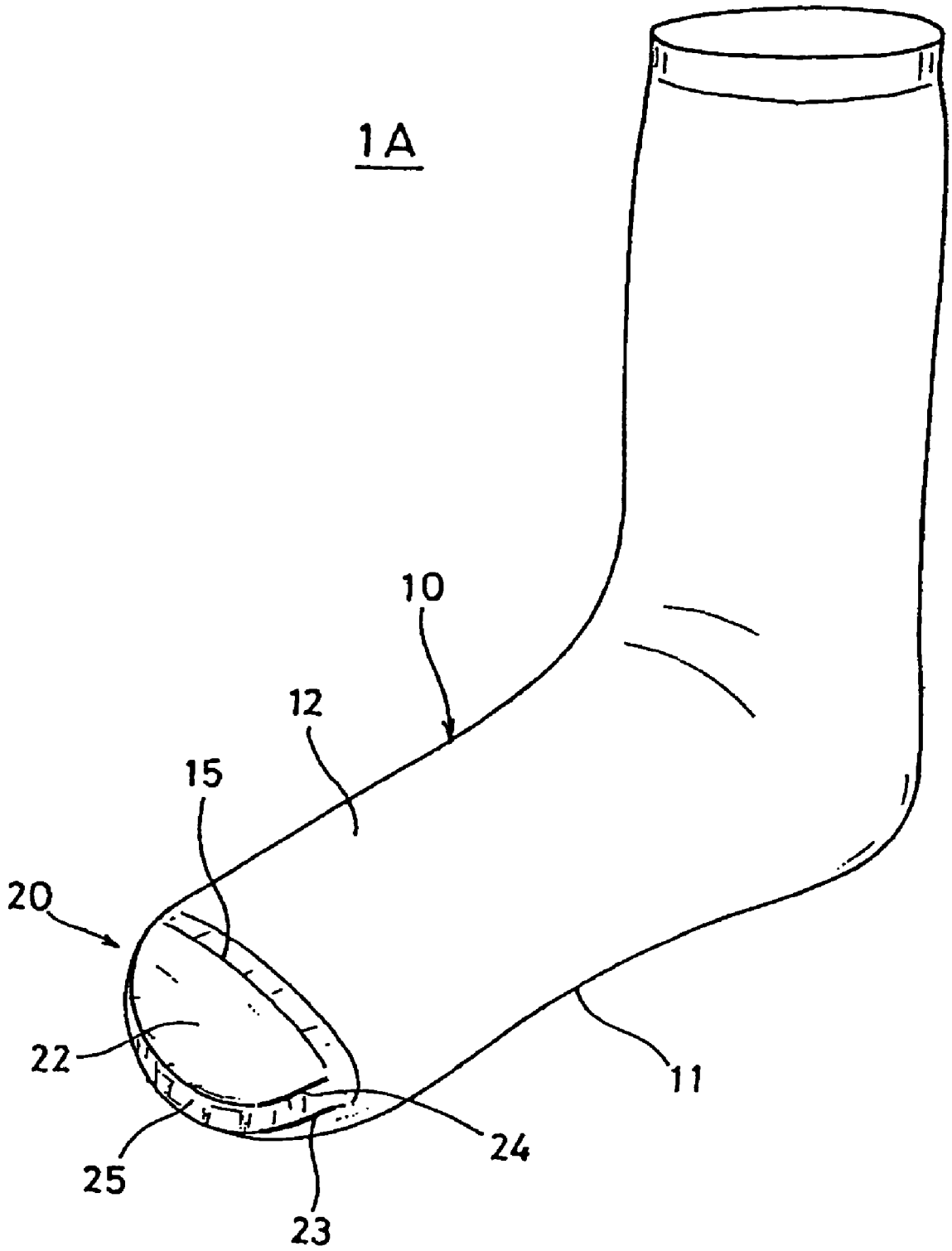
FIG. 1 a perspective view of a sock according to a first embodiment of the present invention.
Figure 2:
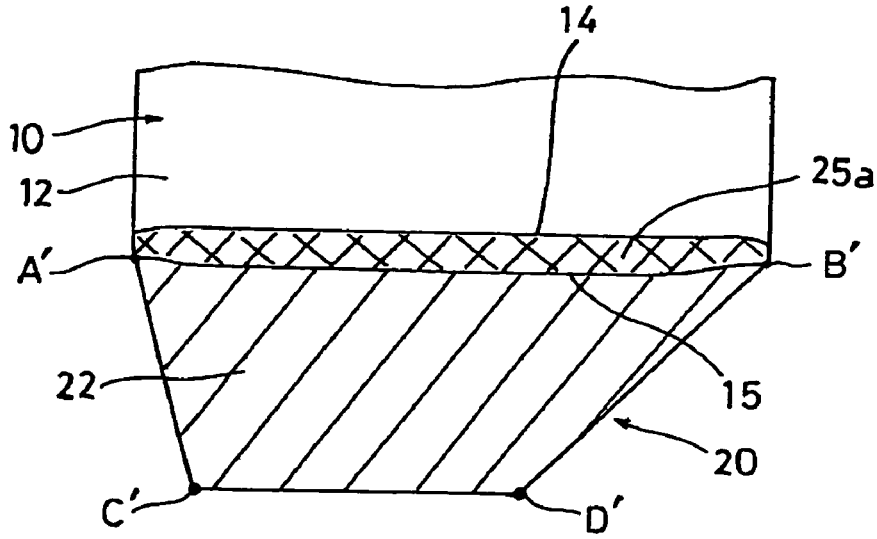
FIG. 2A a schematic illustration of a knitting state of the above described sock, showing an instep side.
FIG. 2B a schematic illustration of a knitting state of the above described sock, seen from a tip side of a toe housing portion.
FIG. 2C a schematic illustration of a knitting state of the above described sock, showing a sole side.
FIG. 2D a schematic side illustration of a knitting state of the above described sock.
Figure 2:
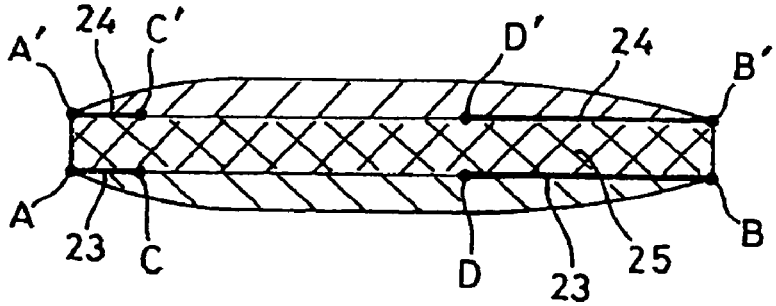
Figure 2:
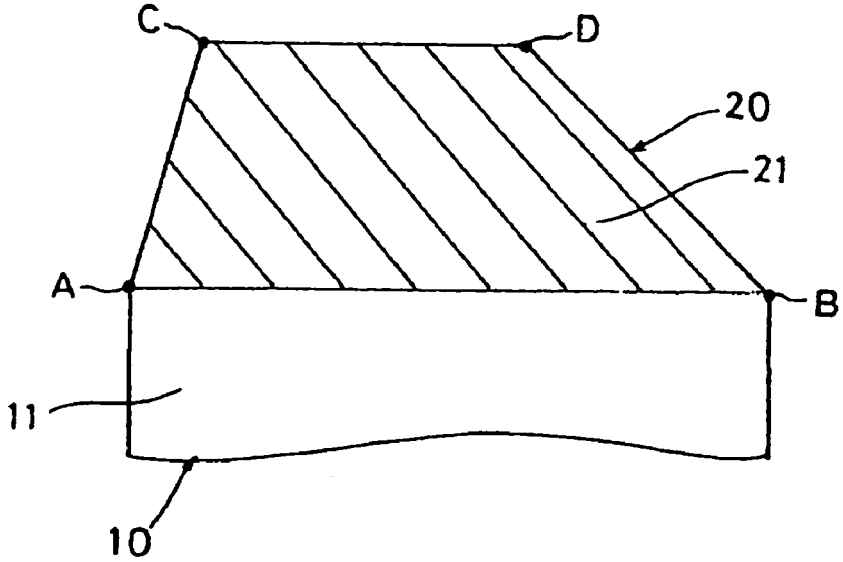
Figure 2:
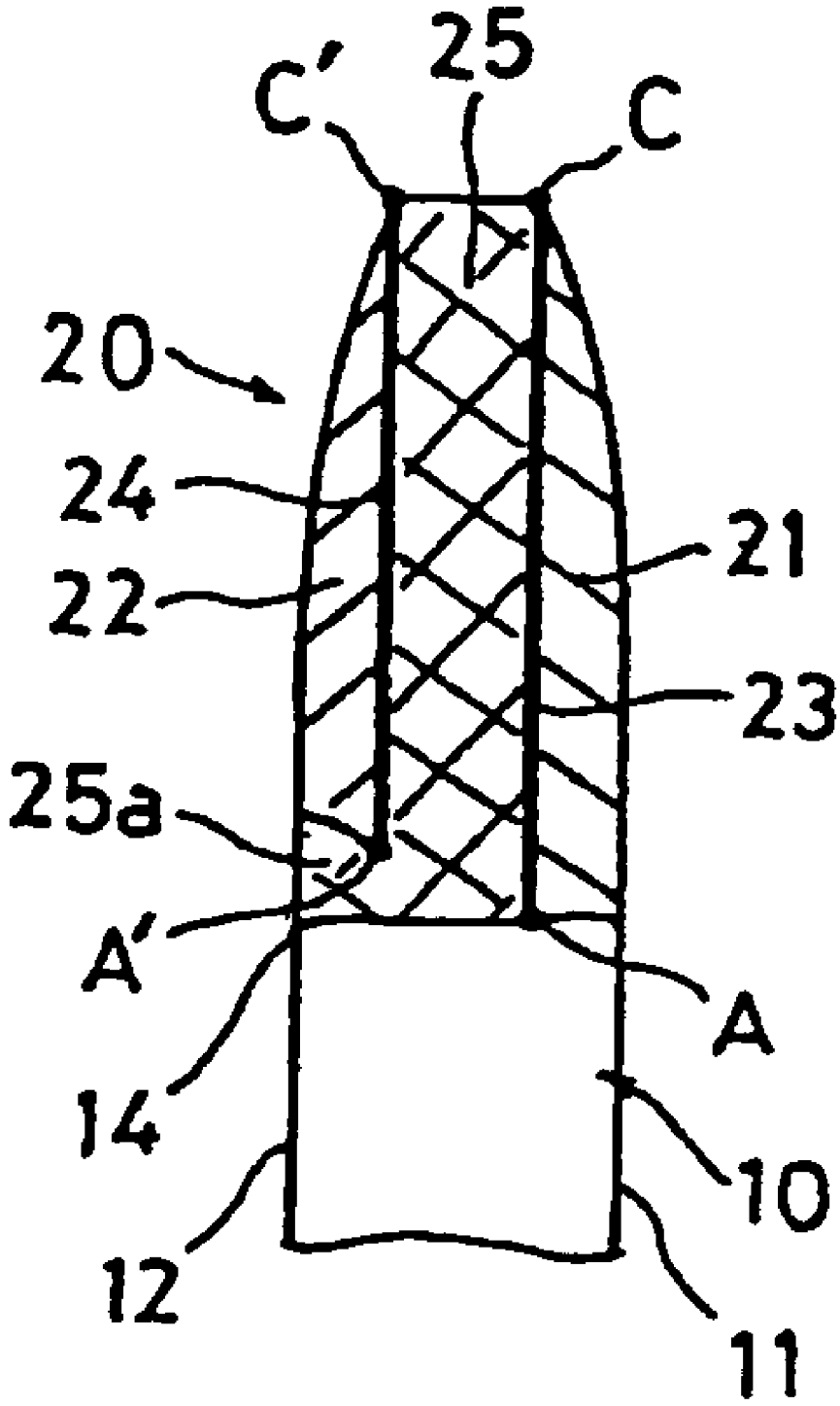

FIG. 1 is a perspective view of a sock according to a first embodiment of the present invention, and FIG. 2 is a schematic illustration of a knitting state of the sock.

The sock 1A according to a first embodiment in FIGS. 1 and 2 is knitted integrally by a sock knitting machine like a conventional one, and has a cylindrically knitted portion 10 which forms a sole portion 11 and an instep portion 12, and a toe housing portion 20 provided continuously with the cylindrically knitted portion, and the toe housing portion 20 is provided with a forwardly knitted portion 25 for increasing functions between a front portion 22 and a back portion 21 invertedly knitted to form a substantially planar trapezoidal shape having a progressively reduced knitting width toward a tip, along contour portions thereof.

The toe housing portion 20 of the sock 1A may have a laterally symmetrical substantially planar trapezoidal shape, but preferably has a laterally asymmetrical substantially planar trapezoidal shape slanted to a thumb side as shown in practice.

The sock 1A is knitted by the sock knitting machine by cylindrically knitting the sole portion 11 and the instep portion 12 integrally, and knitting the toe housing portion 20 that houses a toe continuously with the cylindrically knitted portion 10. In this knitting, both the front portion 22 and the back portion 21 of the toe housing portion 20 are invertedly knitted with changing knitting widths thereof so as to form a substantially planar trapezoidal shape having a progressively reduced knitting width toward a tip of the sock as shown in FIGS. 2A and 2C, the knitted portion 25 is forwardly knitted between the invertedly knitted front portion 22 and the invertedly knitted back portion 21 along respective contours thereof, and as shown in FIGS. 2B and 2D, the forwardly knitted portion 25 is provided between the front portion 22 and the back portion 21.

Specifically, the back portion 21 of the toe housing portion 20 is knitted continuously with an end (an AB position in FIG. 2) of one of the sole portion 11 and the instep portion 12 in the cylindrically knitted portion 10, for example, an end of the sole portion 11 while gradually reducing a knitting width thereof so as to form a substantially planar trapezoidal shape by inversion knitting of alternately repeating forward rotation and reverse rotation of the sock knitting machine. Namely, knitting is performed to reduce the number of knitting needles relating to the knitting by one stitch (one wale) for every required number of knitting courses (for example, one or a plurality of courses) at one inversion position and the other inversion position in the sock knitting machine from a knitting needle region of a maximum knitting width toward a knitting needle region of a target minimum knitting width in the knitting machine.

Next, the knitted portion 25 for increasing functions is forwardly knitted continuously with the back portion 21. Specifically, when the back portion 21 reaches a minimum knitting width position (a CD position in FIG. 2), the knitting machine is returned in a stroke to the knitting needle region of the maximum knitting width, and forward knitting is performed along the contour of the back portion 21 continuously therewith for knitting the required number of courses (FIG. 2B). The forward knitting is cylindrical knitting around an opening end 14 of the instep portion 12 of the cylindrically knitted portion 10 from an end of the contour of the back portion 21 of the toe housing portion 20, and this allows the knitted portion 25 to be forwardly knitted without problems. Reference numeral 23 denotes a connecting portion (gore line) between the knitted portion 25 and the back portion 21.

Further, continuously with the knitted portion 25, the front portion 22 of the toe housing portion 20 is knitted by inversion knitting while gradually increasing the knitting width thereof contrary to the back portion 21 so as to form a substantially planar inverted trapezoidal shape corresponding to the back portion 21. Specifically, when the knitted portion 25 for the predetermined number of courses is knitted, the knitting machine is returned in a stroke to a knitting needle region of a minimum knitting width position (a C'D' position in FIG. 2A) in the front portion 22 in the knitting machine, and in this state, knitting is performed to increase the number of knitting needles relating to the knitting at opposite inversion positions by one stitch (one wale) for every required number of knitting courses contrary to the above toward a knitting needle region of a maximum knitting width position (an A'B' position in FIG. 2A). At this time, opposite ends of the front portion 22 are knitted continuously with corresponding portions of the forwardly knitted portion 25. Thus, the knitted portion 25 is provided between the back portion 21 and the front portion 22 along contours thereof. Reference numeral 24 denotes a connecting portion (a gore line) between the knitted portion 25 and the front portion 22.

Thus, after knitting to the maximum knitting width position (the A'B' position), an end of the front portion 22 is finally seamed with a front portion 25*a* of the knitted portion 25 forwardly knitted along the opening end 14 of the instep portion 12 of the cylindrically knitted portion 10 by means such as connection knitting to complete knitting of the sock 1A having the above described configuration, that is, the sock 1A provided with the forwardly knitted portion 25 along the contour portion of the toe housing portion 20. Reference numeral 15 denotes a seam portion between the instep portion 12 and the toe housing portion 20.

In FIGS. 2A to 2D, the contours of the back portion 21 and the front portion 22 of the toe housing portion 20 and the connecting portions 23 and 24, or the like are shown by straight lines for convenience, but actually, these portions have roundness peculiar to knitted fabric according to yarn used or knitting textures, and the sock 1A as shown in FIG. 1 can be obtained. Further, in the embodiment, the case of knitting from the back portion 21 of the toe housing portion 20 is described, but contrary to this, knitting may be performed from the front portion 22 in the same manner as described above.

In knitting of the sock 1A, rates of decrease and increase or decrement and increment of the knitting needles that contribute to knitting at opposite inversion positions in inversion knitting of the back portion 21 and the front portion 22 of the toe housing portion 20 can be appropriately set according to a shape of the toe housing portion 20 to be knitted, particularly, slanting shapes of opposite ends thereof or the like.

Specifically, when the toe housing portion 20 is knitted to form a laterally symmetrical substantially planar trapezoidal shape, the rates of decrease or increase of the knitting needles at the opposite inversion positions may be equal, and when the toe housing portion 20 is knitted to form a laterally asymmetrical substantially planar trapezoidal shape, the rates of decrease or increase of the knitting needles at the opposite inversion positions may be different.

For example, decrease or increase by one stitch (one wale) for each knitting course at the opposite inversion positions allows knitting to form a laterally symmetrical substantially planar trapezoidal shape. Decrease or increase by one stitch (one wale) for a plurality of courses on one side (a thumb side) of the opposite inversion positions, and decrease or increase by one stitch (one wale) for each knitting course on the other side (a little finger side) allows knitting to form a substantially planar trapezoidal shape slanted to one side to be the thumb side as shown.

If the rate of decrease or increase of the number of knitting needles that contribute to knitting is one stitch (one wale) for a plurality of courses at the opposite inversion positions, and the degree of decrease or increase of stitches is relatively small (for example, decrease or increase by one stitch for a unit course of three or more courses), the decrease or increase by one stitch (one wale) for every courses of the above described number increases changes to increase spaces in connection knitting with the forwardly knitted portion 25, thereby creating gaps in a product.

Figure 3:
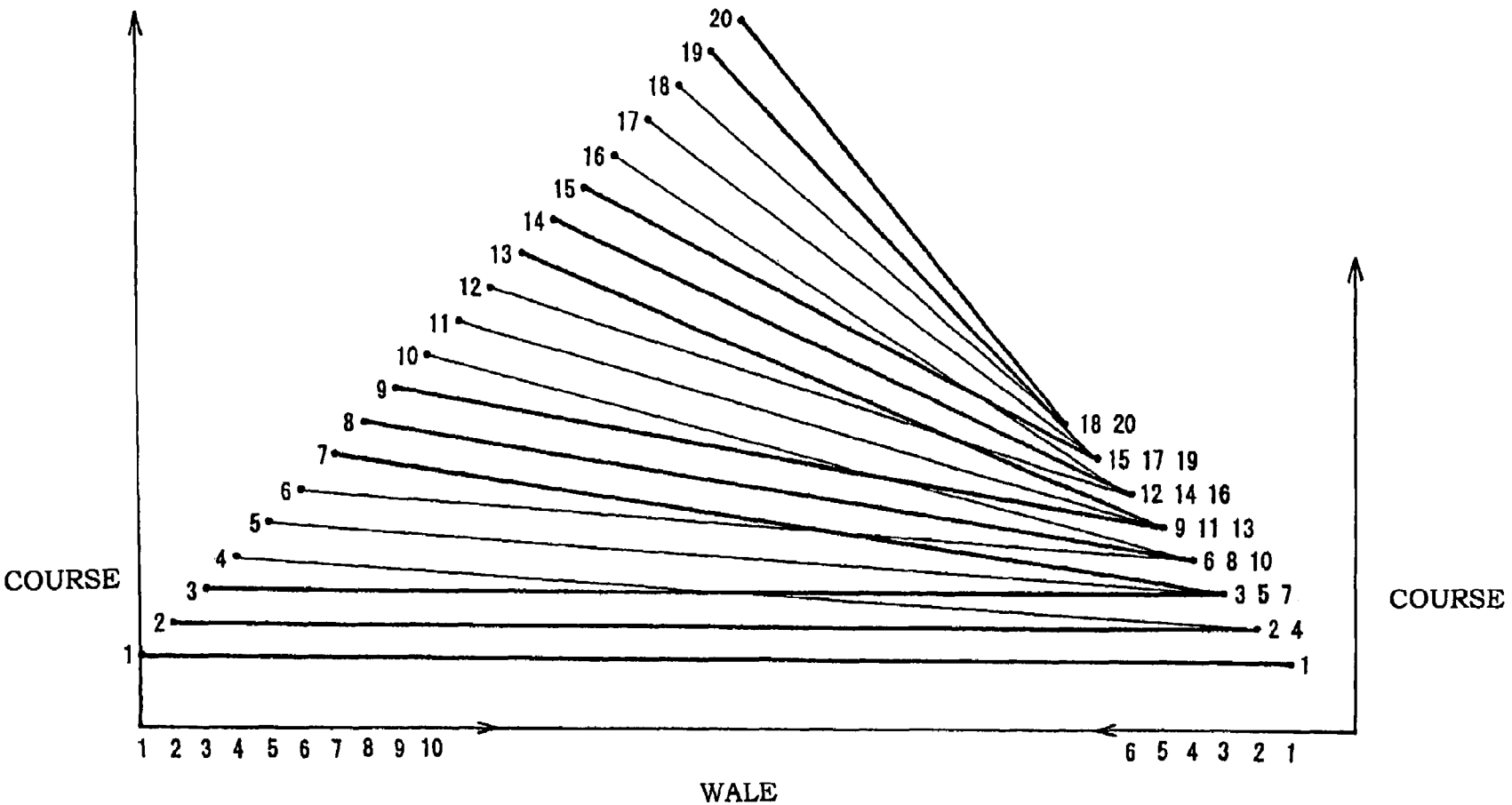
FIG. 3 an illustration of a state of change at inversion positions.

Thus, generally, as illustrated in FIG. 3, knitting is performed by decrease or increase by one wale for each course in a unit of three courses, and then returning by two wales and two courses at an inversion position, stitches are formed on previously formed stitches and then a succeeding course is knitted. Thus, it is desirable that the knitting is repeated of decreasing or increasing by one wale for each course in the unit of three courses, and then returning by two wales and two courses and forming the stitches as described above, and knitting is performed with the reduced number of stitches at a side end to allow substantially uniform connection knitting with relatively small spaces with the forwardly knitted portion 25 to prevent gaps in the connecting portion from being enlarged.

FIG. 3 illustrates a state of change at the opposite inversion positions in a unit of three courses, and shows each knitting course with thick solid lines and thin solid lines for every three courses, and numerical values at laterally opposite ends denote knitting course order. In FIG. 3, knitting is repeated of decreasing by one stitch (one wale) for each knitting course at a left inversion portion in the figure, decreasing by one wale for each course in a unit of three courses at a right inversion portion in the figure, then returning by two wales and two courses, and forming stitches on previously formed stitches. By such knitting, three stitches are formed on one another in courses of intermediate portions at a right inversion position (a side end), and the number of rows of stitches in a wale direction and a course direction is reduced by about one third of that at a left inversion position as shown in FIG. 3. Thus, the stitch portion of each row is connectedly knitted with the forwardly knitted portion 25, and thus a knitted fabric portion by inversion knitting (the back portion or the front portion of the toe housing portion) is drawn to the right, and the knitted fabric is therefore formed into a laterally asymmetrical substantially planar trapezoidal shape. For increasing the knitting width, knitting is performed with changes opposite to those described above.

The sock 1A thus knitted is provided with the forwardly knitted portion 25 between the back portion 21 and the front portion 22 at the contour portion of the toe housing portion 20, that is, contour portions of a tip portion and opposite sides, and thus the entire toe housing portion 20 has a large thickness to be three-dimensional, and causes no feeling of tightness or pressure in fingertips when the toe is housed. Particularly, the knitted portion 25 in the contour portion allows easy fitting to a round toe portion, and the sock can be worn comfortably.

Further, the knitted portion 25 is forwardly knitted in the entire contour portion of the toe housing portion 20, and thus on the opposite sides of the toe housing portion 20, two connecting portions (gore lines) 23 and 24 of the knitted portion 25 and the back portion 21 and the front portion 22 of the toe housing portion 20 simply appear in parallel and are inconspicuous, and the sock is simple and neat, and causes no tightening of knitted fabric itself, and has good appearance.

Figure 6:
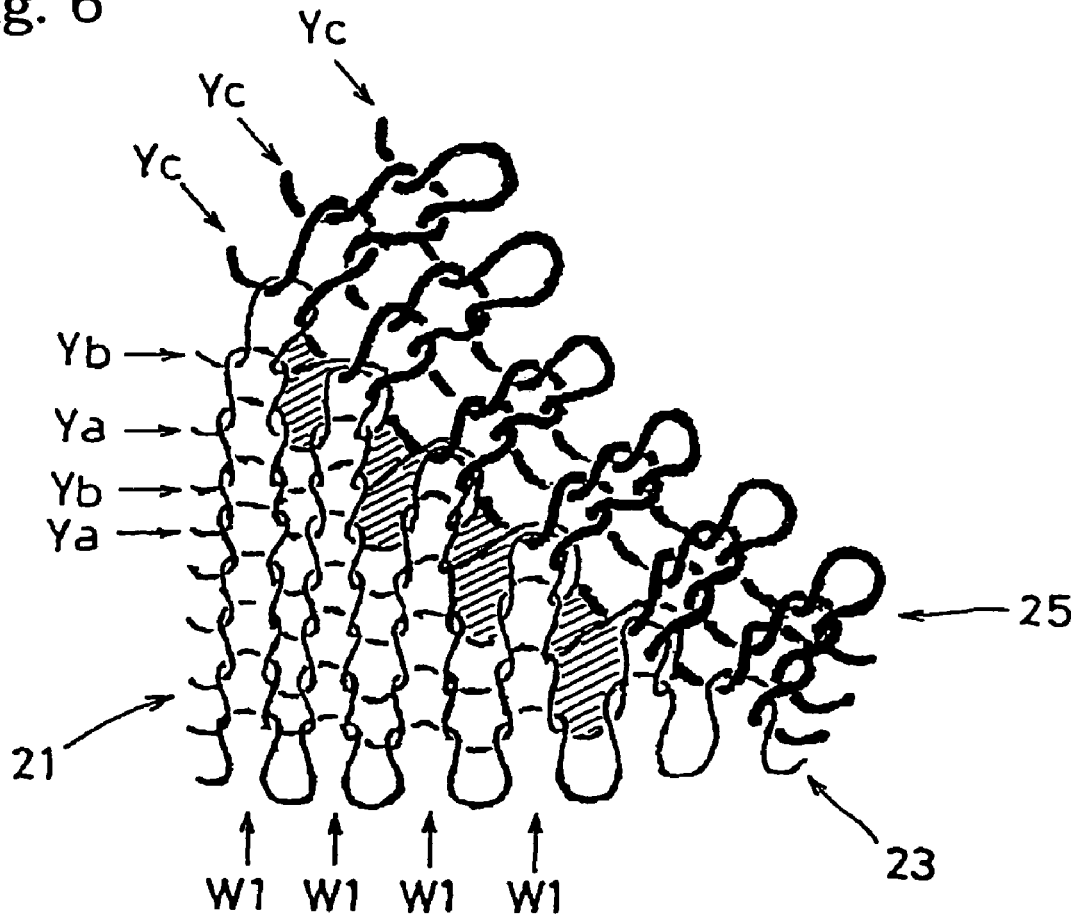
FIG. 6 a view of a knitting texture for illustrating the connection portion of a product of the present invention.
Figure 7:
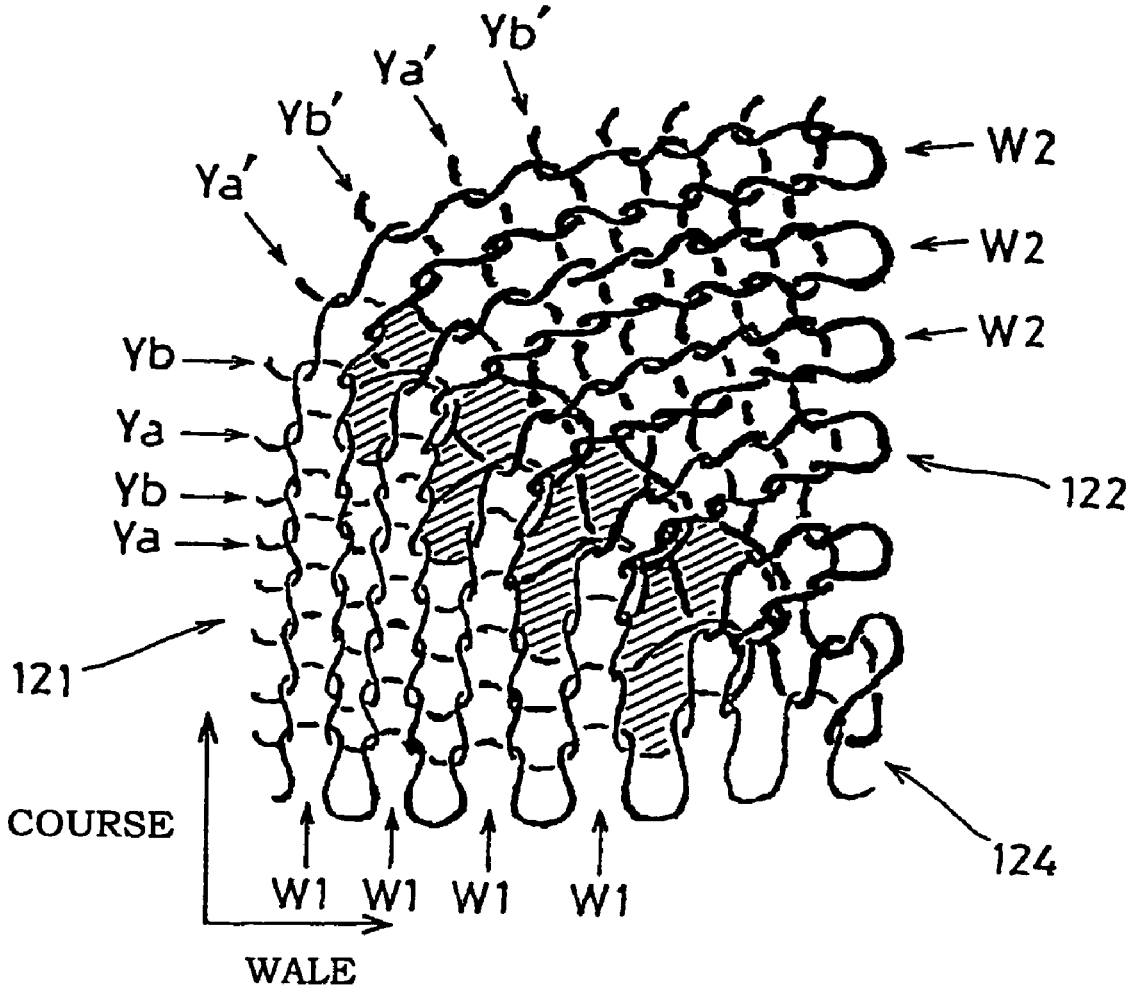
FIG. 7 a view of a knitting texture for illustrating a connecting portion of a conventional product.
Figure 8:
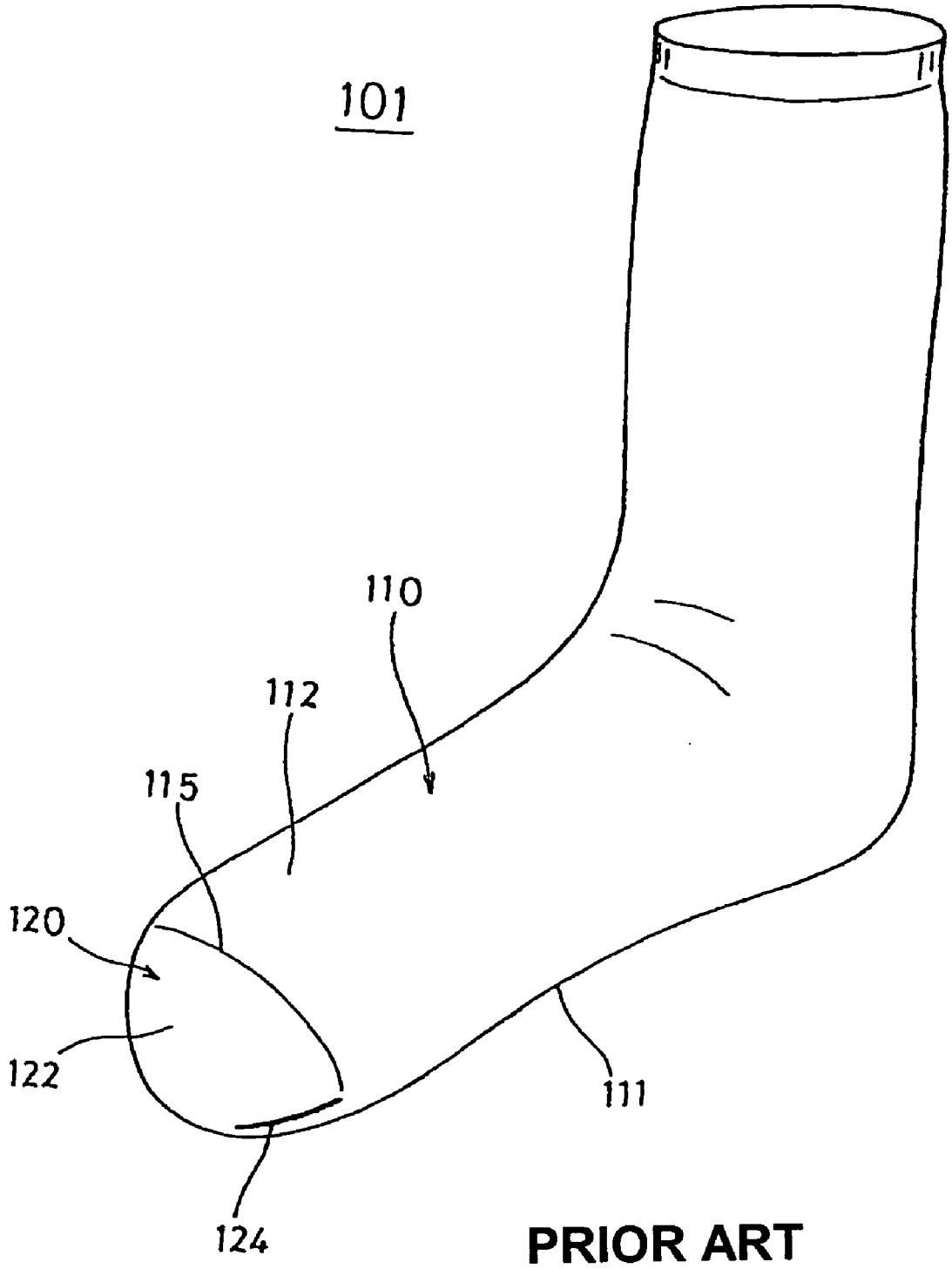
FIG. 8 a perspective view of a conventional sock.
Figure 9:
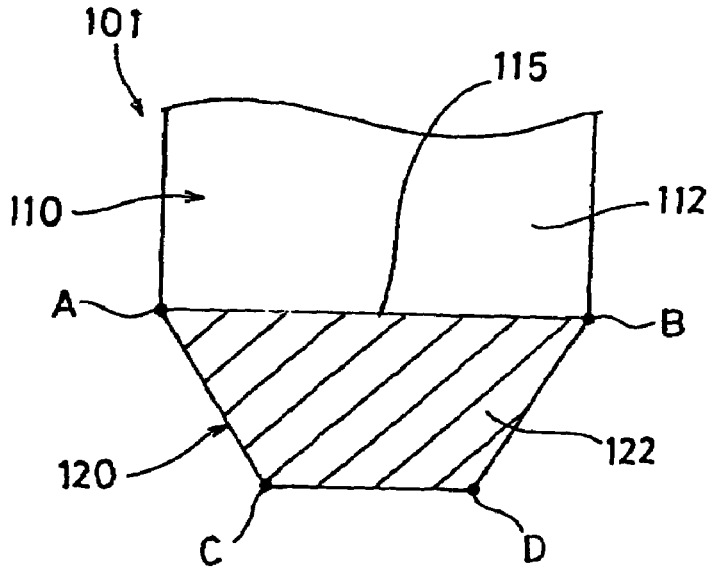
FIG. 9A a schematic illustration of a knitting state of the above described sock, showing an instep side.
FIG. 9B a schematic illustration of a knitting state of the above described sock, seen from a tip side of a toe housing portion.
FIG. 9C a schematic illustration of a knitting state of the above described sock, showing a sole side.
Figure 9:
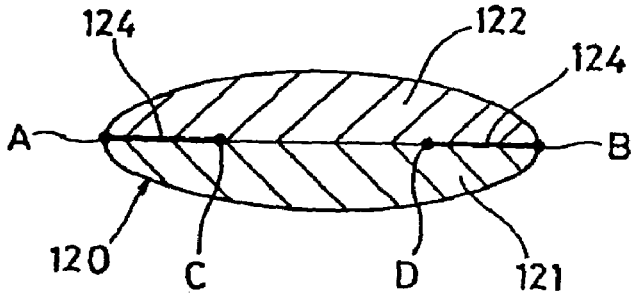
PRIOR ART Fig. 9 (B)
Figure 9:
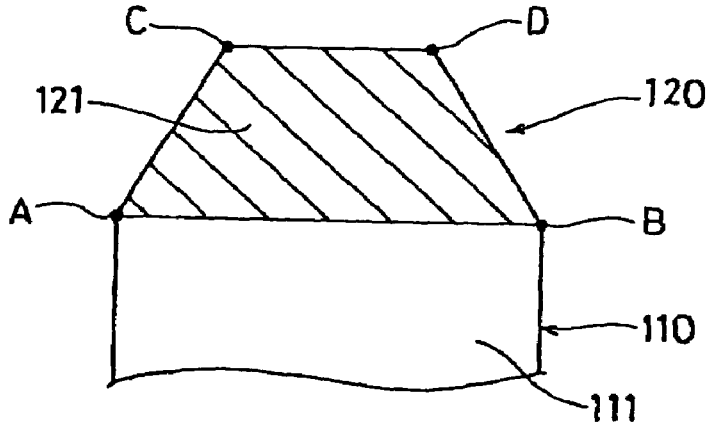
PRIOR ART Fig. 9 (C)

This point will be described with reference to FIG. 6 showing a knitting texture corresponding to the connecting portion of the product of the present invention, and FIG. 7 showing a knitting texture corresponding to a connecting portion of a conventional product (FIGS. 8 and 9).

In FIG. 6, stitch portions by thin lines show the back portion 21 of the toe housing portion, and stitch portions by thick lines show the forwardly knitted portion 25. Further, in the figure, Ya denotes yarn in a course on the forward rotation side of the back portion 21, Yb denotes yarn in a course on the reverse rotation side, Yc denotes yarn in each course of the forwardly knitted portion 25, and 23 denotes the connecting portion between the back portion 21 and the forwardly knitted portion 25. In FIG. 7, stitch portions by thin lines show a back portion 121 of a toe housing portion, and stitch portions by thick lines show a front portion 122. Further, in the figure, Ya denotes yarn in a course on a forward rotation side of the back portion 121, Yb denotes yarn in a course on a reverse rotation side, Ya' denotes yarn in a course on a forward rotation side of the front portion 122, Yb' denotes yarn in a course on a reverse rotation side, and 124 denotes a connecting portion between the back portion 121 and the front portion 122.

As is apparent from FIG. 7, for the conventional product, the yarn Ya and Yb in each course of the back portion 121 is knitted with sequentially reduced stitches at side ends that are inversion positions of forward rotation and reverse rotation, and threaded across two wales W1 and W1 at the portions, and stitch spaces (diagonally shaded portions) between the wales W1 and W1 become relatively large in the reduced stitch portions. Yarn Ya' and Yb' in each course of the front portion 122 connected to the yarn Ya and Yb is knitted with sequentially increased stitches at side ends contrary to the above, threaded across two wales W2 and W2 at the portions, and connectedly knitted to each wale W1 of the back portion 121 with reduced stitches. Also in the increased stitch portions of Ya' and Yb' in the front portion, stitch spaces (diagonally shaded portions) between the wales W2 and W2 become relatively large, and the stitch spaces are enlarged in the connecting portion 124 where the wales W1 and W2 are connected, and knitted fabric in a tighter state causes more conspicuous and larger gaps to be created, impairing the appearance.

On the other hand, in the present invention, as is apparent from FIG. 6, yarn Ya and Yb in each course of the back portion 21 is knitted with sequentially reduced stitches at side ends that are inversion position of forward rotation and reverse rotation, and threaded across two wales at the portions, and stitch spaces (diagonally shaded portions) between the wales become relatively large. However, yarn Yc of the forwardly knitted portion 25 is connected to each wale of the back portion 21 with reduced stitches as described above while forming stitches by forward knitting. This prevents opening of the stitch spaces between the wales in the connecting portion 23, creates no large gap when the sock is worn, causes no tightening, and provides good appearance.

Besides, the sock may have various functions in the contour portion of the toe housing portion 20 using a knitting texture of the forwardly knitted portion 25. For example, the knitted portion 25 is knitted to have a mesh texture, the contour portion of the toe housing portion 20 may have breathability, thereby allowing a sock that prevents sweating to be obtained. Also, various functions applicable to general forward knitting can be easily provided, such as of knitting patterns by changes of textures of the knitted portion 25, or increasing strength.

Figure 4:
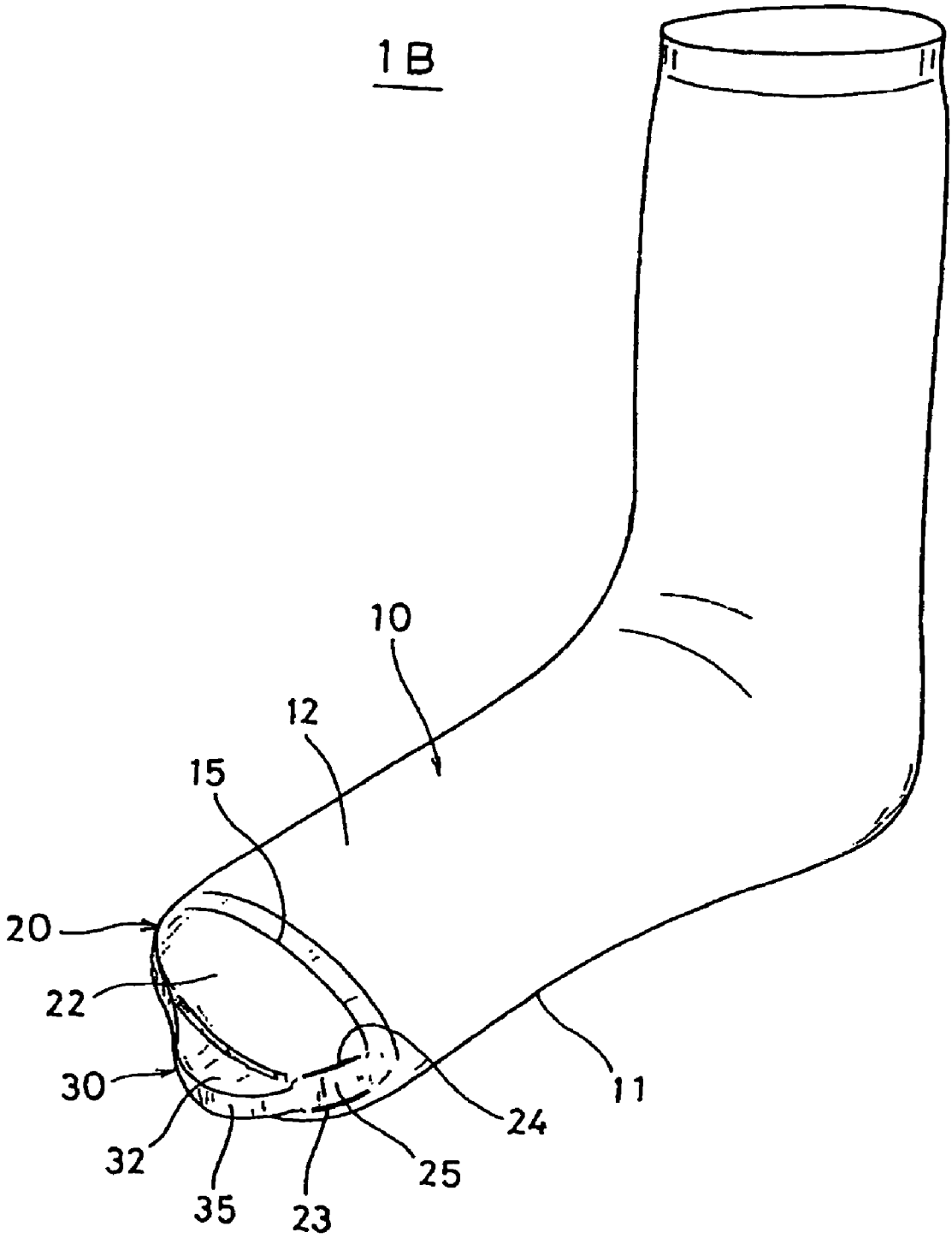
FIG. 4 a perspective view of a sock according to a second embodiment of the present invention.
Figure 5:
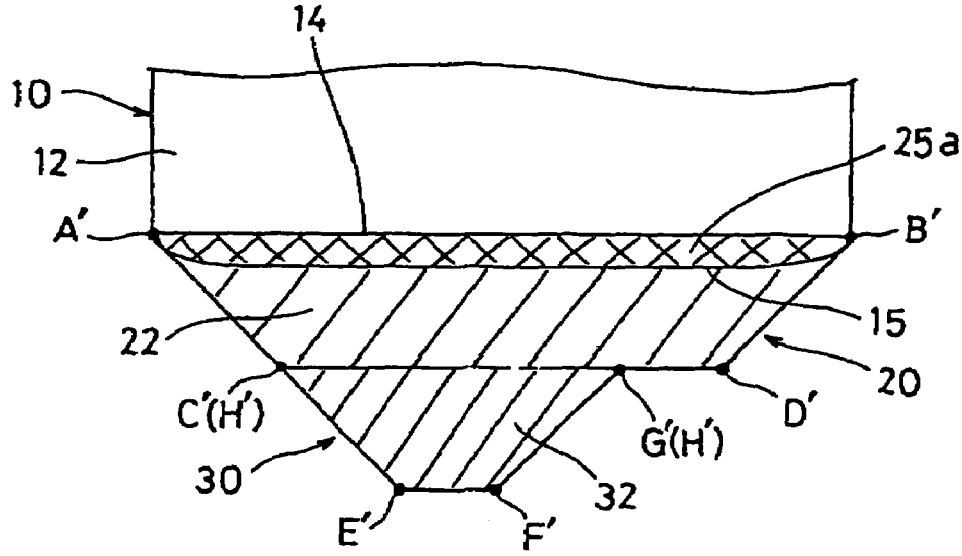
FIG. 5A a schematic illustration of a knitting state of the above described sock, showing an instep side.
FIG. 5B a schematic illustration of a knitting state of the above described sock, seen from a tip side of a toe housing portion.
FIG. 5C a schematic illustration of a knitting state of the above described sock, showing a sole side.
FIG. 5D a schematic side illustration of a knitting state of the above described sock.
Figure 5:
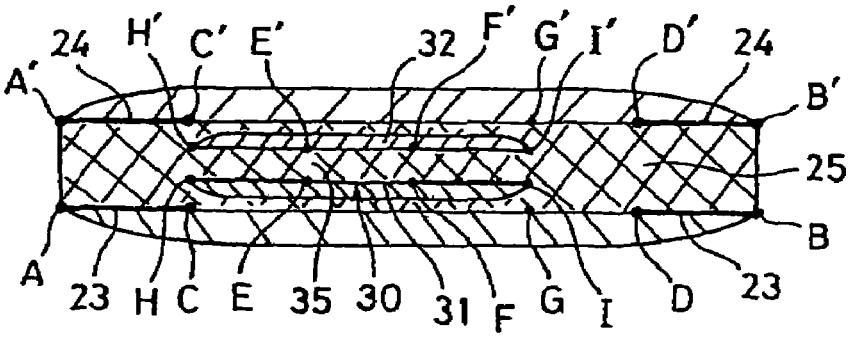
Figure 5:
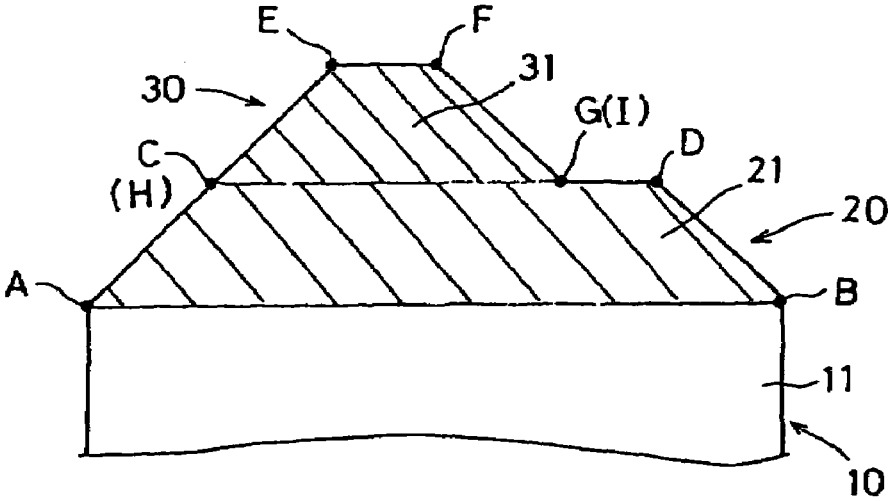
Figure 5:
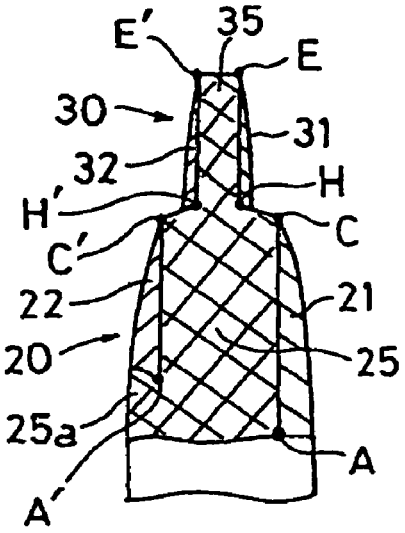

FIG. 4 is a perspective view of a sock according to a second embodiment of the present invention, and FIG. 5 illustrates a knitting state of the sock.

The sock 1B according to the embodiment in FIGS. 4 and 5A to 5D is also knitted integrally by a sock knitting machine as in the first embodiment, and has a cylindrically knitted portion 10 which forms a sole portion 11 and an instep portion 12, and a toe housing portion 20 provided continuously with the cylindrically knitted portion, and the toe housing portion 20 is provided with a forwardly knitted portion 25 for increasing functions between a front portion 22 and a back portion 21 invertedly knitted to form a substantially planar trapezoidal shape having a progressively reduced knitting width toward a tip, along contours thereof.

As a feature of the sock 1B of the second embodiment, in addition to the above described configuration, at a part of the forwardly knitted portion 25 of the toe housing portion 20, a small toe portion 30 for a thumb protruding to form a substantially planar trapezoidal shape is provided continuously with the knitted portion 25 in a position slanted to a thumb side. The small toe portion 30 may include a back side 31 and a front side 32 continuous therewith, but in the shown embodiment, a forward knitted portion 35 is provided between the front side 32 and the back side 31 of the small toe portion 30 along contours thereof. Particularly, the forward knitted portion 35 is forwardly knitted integrally with the knitted portion 25 of the toe housing portion 20.

The sock 1B according to this embodiment is also knitted by the sock knitting machine by cylindrically knitting the sole portion 11 and the instep portion 12 integrally, and integrally knitting the toe housing portion 20 continuously with the cylindrically knitted portion 10. In this knitting, both the front portion 22 and the back portion 21 of the toe housing portion 20 are invertedly knitted with changing knitting widths thereof so as to form a substantially planar trapezoidal shape having a progressively reduced knitting width toward a tip of the sock as shown in FIGS. 5A and 5C, knitting is performed so as to decrease or increase the number of knitting needles that contribute to knitting at opposite inversion positions in the knitting machine, and the knitted portion 25 is forwardly knitted between the invertedly knitted front portion 22 and the invertedly knitted back portion 21 along respective contours thereof, basically in the same manner as in the first embodiment.

In the sock 1B according to the second embodiment, particularly in the course of knitting the forwardly knitted portion 25, the back side 31 and the front side 32 of the small toe portion 30 are invertedly knitted with changing the knitting widths thereof in a knitting needle region for knitting the toe housing portion 20 in the sock knitting machine to form a substantially planar trapezoidal shape having a progressively reduced knitting width toward a tip of the sock. Particularly, in the shown embodiment, the forward knitted portion 35 along the contours of the front side 32 and the back side 31 of the small toe portion 30 is forwardly knitted with the knitted portion 25 so that the forward knitted portion 35 is provided between the front side 32 and the back side 31.

Specifically, as shown in FIG. 5C, the back portion 21 of the toe housing portion 20 is knitted by inversion knitting continuously with, for example, an end (an AB position) of the sole portion 11 of the cylindrically knitted portion 10 while gradually reducing a knitting width thereof so as to form a substantially planar trapezoidal shape. Namely, knitting is performed to reduce the number of knitting needles relating to the knitting by one stitch (one wale) for every required number of knitting courses (for example, one or a plurality of courses) at opposite inversion positions in the sock knitting machine from a knitting needle region of a maximum knitting width (the AB position) toward a knitting needle region of a target minimum knitting width in the knitting machine.

When the back portion 21 reaches a target minimum knitting width position (a CD position), the knitting machine is returned in a stroke to the knitting needle region of the maximum knitting width, and the knitted portion 25 is forwardly knitted continuously with the back portion 21. When the forward knitting advances by several courses, inversion knitting is performed from a knitting needle region in a set maximum knitting width position (an HI position) for knitting the small toe portion 30 toward the knitting needle region of the target minimum knitting width, the number of knitting needles relating to the knitting is reduced by one stitch for every required number of knitting courses (for example, one or a plurality of courses) at opposite inversion positions, and the back side 31 of the small toe portion 30 is knitted.

When the back side 31 reaches a minimum knitting width position (an EF position), the knitting machine is returned in a stroke to the knitting needle region of the maximum knitting width of the small toe portion 30, forward knitting is performed together with the knitted portion 25 of the toe housing portion 20 along the contour of the back side 31 continuously therewith, and the forward knitted portion 35 is knitted across a required number of courses.

Further, when the forward knitted portion 35 is knitted across the required number of courses, the front side 32 of the small toe portion 30 is knitted continuously therewith by inversion knitting while gradually increasing the knitting width thereof. Specifically, after knitting of the thickness increased portion 35, the knitting machine is returned in a stroke to a knitting needle region in a minimum knitting width position (an E'F' position) of the back side 31 in the knitting machine, and in this state, the front side 32 of the small toe portion 30 is knitted so as to increase the number of knitting needles relating to knitting at opposite inversion positions by one stitch (one wale) for every required number of knitting courses contrary to the above toward the knitting needle region of the maximum knitting width of the small toe portion 30. At this time, opposite ends of the front side 32 are knitted continuously with corresponding portions of the forward knitted portion 35. Thus, the forward knitted portion 35 is provided between the back side 31 and the front side 32 along the contour thereof. Reference numerals 33 and 34 in the figure denote connecting portions (gore lines) between the forward knitted portion 35 and the back side 31 and the front side 32.

Thus, after the knitting of the small toe portion 30 is finished, the knitting machine is returned in a stroke to the knitting needle region of the maximum knitting width of the toe housing portion 20 and performs forward knitting, and the forwardly knitted portion 25 is knitted across several courses.

Then, continuously with the knitted portion 25, the front portion 22 of the toe housing portion 20 is knitted by inversion knitting while gradually increasing the knitting width contrary to the back portion 21 so as to form a substantially planar inverted trapezoidal shape corresponding to the back portion 21. Specifically, after the knitting of the knitted portion 25 is finished, the knitting machine is returned in a stroke to a knitting needle region of a minimum knitting width position (a C'D' position) of the front portion 22 in the knitting machine, and in this state, knitting is performed to increase the number of knitting needles relating to the knitting at opposite inversion positions by one stitch (one wale) for every required number of knitting courses contrary to the above toward a knitting needle region of a maximum knitting width position (an A'B' position). At this time, opposite ends of the front portion 22 are knitted continuously with corresponding portions of the forwardly knitted portion 25.

Then, an end of the front portion 22 is finally connectedly knitted to a front portion 25*a* of the knitted portion 25 knitted along an opening end 14 of the instep portion 12 of the cylindrically knitted portion 10 and seamed together. Thus, the sock 1B having the above described configuration, specifically, the sock 1B provided with the forwardly knitted portion 25 along the contour of the toe housing portion 20 and also with the small toe portion 30 protruding at a part of the knitted portion 25 can be obtained.

For the sock 1B according to the embodiment, the planar shape of the toe housing portion 20 is not limited to the laterally symmetrical substantially planar trapezoidal shape, but may be the laterally asymmetrical substantially planar trapezoidal shape slanted to a thumb side as in the first embodiment, and the degree of slanting of the opposite contours may be appropriately set according to rates of decrease and increase of knitting needles that contribute to knitting.

The planer shape, the forming position, and the size of the small toe portion 30 may be freely set. For example, the small toe portion 30 may be formed from an intermediate position between AC in FIG. 5C, or formed to be shifted to the middle.

Further, rates of decrease and increase or decrement and increment of the knitting needles that contribute to knitting at opposite inversion positions in inversion knitting of the back portion 21 and the front portion 22 of the small toe portion 30 can be appropriately set according to a shape of the small toe portion to be knitted in the same manner as for the back portion 21 and the front portion 22 of the toe housing portion 20. For example, when the small toe portion 30 is knitted to form a laterally symmetrical substantially planar trapezoidal shape, the rates of decrease or increase of the knitting needles at the opposite inversion positions may be equal, and when the small toe portion 30 is knitted to form a laterally asymmetrical substantially planar trapezoidal shape, the rates of decrease or increase of the knitting needles at the opposite inversion positions may be different. In either case, the small toe portion 30 is formed to be suitable for housing a tip portion of a thumb that is the largest and protrudes among fingers of a foot.

The sock 1B thus knitted is provided with the forwardly knitted portion 25 between the back portion 21 and the front portion 22 of the toe housing portion 20, and thus the entire toe housing portion 20 has a large thickness to be three-dimensional, and causes no feeling of tightness or pressure in fingertips when the toe is housed. Further, the small toe portion 30 that can house the tip portion of the thumb is provided at a part of the knitted portion 25, thus the thumb side can be housed without a feeling of tightness, and the sock can be comfortably worn with better appearance. Particularly, if the small toe portion 30 is provided at a part of the knitted portion 25 so as to be slanted to the thumb side, the tip portion of the thumb can be properly housed, and the knitted fabric is not excessively stretched.

INDUSTRIAL UTILITY

The present invention can be applied to various socks knitted and produced by a sock knitting machine.

The invention claimed is:

1. A sock knitted integrally by a sock knitting machine, the sock comprising:

a cylindrically knitted portion which forms a sole portion and an instep portion; and a toe housing portion provided continuously with the cylindrically knitted portion, wherein said toe housing portion includes an invertedly knitted front portion having a substantially planar trapezoidal shape, an invertedly knitted back portion having a substantially planar trapezoidal shape, and a knitted portion which is provided as a forwardly knitted portion between said invertedly knitted front portion and said invertedly knitted back portion along contours of these front and back portions, and said knitted portion of said toe housing portion being cylindrical.

2. The sock according to claim 1, wherein said toe housing portion has a laterally asymmetrical substantially planar trapezoidal shape offset slanted to a thumb side.

3. The sock according to claim 1, wherein a small toe portion projecting in a substantially planar trapezoidal shape is provided at a part of said forwardly knitted portion of the toe housing portion, said small toe portion being provided continuously with the forwardly knitted portion.

4. A method of knitting a sock by a sock knitting machine, the method comprising the steps of:

knitting a cylindrically knitted portion forming a sole portion and an instep portion integrally with each other; and knitting a toe housing portion for accommodating a toe continuously with said cylindrically knitted portion, wherein said step of knitting the toe housing portion includes the steps of:

invertedly knitting one of a front portion and a back portion of said toe housing portion with changing knitting widths thereof so as to form a substantially planar trapezoidal shape having a progressively reduced knitting width toward a tip of the sock, forwardly knitting a cylindrical knitted portion continuously from said one of the front and back portions, and invertedly knitting the other of the front and back portions of the toe housing portion continuously from said knitted portion, with reversing in a knitting direction from a knitting direction used for knitting said one portion and also changing knitting widths thereof so as to form a substantially planar trapezoidal shape having a progressively reduced knitting width toward the tip of the sock.

5. The method according to claim 4, wherein in the course of knitting the forwardly knitted portion along a contour of said toe housing portion with forward operation of the sock knitting machine, in a knitting needle region for knitting said toe housing portion of the sock knitting machine, a front side and a back side of a small toe portion are invertedly knitted respectively while changing knitting widths thereof into a substantially planar trapezoidal shape having a progressively reduced knitting width toward a tip of the sock.

6. The sock according to claim 2, wherein a small toe portion projecting in a substantially planar trapezoidal shape is provided at a part of said forwardly knitted portion of the toe housing portion, said small toe portion being provided continuously with the forwardly knitted portion.

7. A sock knitted integrally by a sock knitting machine, the sock comprising:

a cylindrically knitted portion which forms a sole portion and an instep portion; and a toe housing portion provided continuously with the cylindrically knitted portion, wherein said toe housing portion includes an invertedly knitted front portion having a substantially planar trapezoidal shape, an invertedly knitted back portion having a substantially planar trapezoidal shape, and a knitted portion which is provided as a forwardly knitted portion between said invertedly knitted front portion and said invertedly knitted back portion along contours of these front and back portions, and wherein a small toe portion projecting in a substantially planar trapezoidal shape is provided at a part of said forwardly knitted portion of the toe housing portion, said small toe portion being provided continuously with the forwardly knitted portion.

8. A method of knitting a sock by a sock knitting machine, the method comprising the steps of:

knitting a cylindrically knitted portion forming a sole portion and an instep portion integrally with each other; and knitting a toe housing portion for accommodating a toe continuously with said cylindrically knitted portion, wherein at said step of knitting the toe housing portion, both a front portion and a back portion of said toe housing portion are invertedly knitted with changing knitting widths thereof thereby forming a substantially planar trapezoidal shape having a progressively reduced knitting width toward a tip of the sock, and a knitted portion is forwardly knitted between the invertedly knitted front portion and the invertedly knitted back portion along respective contours thereof, thus forming a forwardly knitted portion between the front portion and the back portion, and wherein in the course of knitting the forwardly knitted portion along the contour of said toe housing portion with forward operation of the sock knitting machine, in a knitting needle region for knitting said toe housing portion of the sock knitting machine, a front side and a back side of a small toe portion are invertedly knitted respectively while changing knitting widths thereof into a substantially planar trapezoidal shape having a progressively reduced knitting width toward a tip of the sock.

9. A sock knitted integrally by a sock knitting machine, the sock comprising:

a cylindrically knitted portion which forms a sole portion and an instep portion; and a toe housing portion provided continuously with the cylindrically knitted portion, wherein said toe housing portion includes an invertedly knitted front portion having a substantially planar trapezoidal shape, an invertedly knitted back portion having a substantially planar trapezoidal shape, and a knitted portion which is provided as a forwardly knitted portion between said invertedly knitted front portion and said invertedly knitted back portion along contours of these front and back portions, wherein said toe housing portion has a laterally asymmetrical substantially planar trapezoidal shape offset slanted to a thumb side, and wherein a small toe portion projecting in a substantially planar trapezoidal shape is provided at a part of said forwardly knitted portion of the toe housing portion, said small toe portion being provided continuously with the forwardly knitted portion.

* * * * *